US012710241B2

(12) United States Patent
Underwood et al.

(10) Patent No.: US 12,710,241 B2
(45) Date of Patent: Aug. 18, 2026

(54) FIREARM RECEIVER ASSEMBLIES

(71) Applicants: James Matthew Underwood, Kennesaw, GA (US); Salvador Ochoa, Powder Springs, GA (US); Larry Cullen Underwood, Canton, GA (US)

(72) Inventors: James Matthew Underwood, Kennesaw, GA (US); Salvador Ochoa, Powder Springs, GA (US); Larry Cullen Underwood, Canton, GA (US)

( * ) Notice: Subject to any disclaimer, the term of this patent is extended or adjusted under 35 U.S.C. 154(b) by 3 days.

(21) Appl. No.: 18/944,914

(22) Filed: Nov. 12, 2024

(65) Prior Publication Data

US 2025/0155208 A1 May 15, 2025

Related U.S. Application Data

(60) Provisional application No. 63/558,759, filed on Feb. 28, 2024, provisional application No. 63/548,299, filed on Nov. 13, 2023.

(51) Int. Cl.
*F41A 3/66* (2006.01)
*F41C 23/10* (2006.01)

(52) U.S. Cl.
CPC ..... *F41A 3/66* (2013.01); *F41C 23/10* (2013.01)

(58) Field of Classification Search
CPC ..... F41C 23/10; F41A 3/66
USPC ..... 89/194–197; 42/71.02, 75.01
See application file for complete search history.

(56) References Cited

U.S. PATENT DOCUMENTS

| | | | | |
|---|---|---|---|---|
| 1,085,698 | A | 2/1914 | Nelson | |
| 1,168,024 | A | 1/1916 | Nelson | |
| 1,349,345 | A | 8/1920 | Payne | |
| 2,182,693 | A | 12/1939 | Harton | |
| 2,691,232 | A | 10/1954 | Hoopes | |
| 2,978,826 | A | 4/1961 | Ivy | |
| 3,415,000 | A | 12/1968 | Koucky et al. | |
| 3,715,826 | A | 2/1973 | Seifried | |
| 4,031,648 | A | 6/1977 | Thomas | |
| 4,246,830 | A | 1/1981 | Krieger | |
| 4,420,899 | A | 12/1983 | Bourlet et al. | |
| 4,521,985 | A | 6/1985 | Smith et al. | |
| 4,549,465 | A | 10/1985 | Charron | |
| 4,594,935 | A | 6/1986 | Smith | |
| 4,619,062 | A | 10/1986 | Johnson | |
| 4,742,634 | A | 5/1988 | Swenson | |
| 4,815,226 | A | 3/1989 | Ruger | |
| 4,915,011 | A | 4/1990 | Smith | |
| 5,036,612 | A | 8/1991 | Jennings | |
| 5,090,147 | A | 2/1992 | Pastor | |
| 5,105,570 | A | 4/1992 | Lishness et al. | |
| 5,299,374 | A | 4/1994 | Mathys | |
| 5,386,659 | A | 2/1995 | Vaid et al. | |
| 5,388,362 | A | 2/1995 | Melcher | |
| 5,438,784 | A | 8/1995 | Lenkarski et al. | |
| 5,537,769 | A | 7/1996 | Hargraves et al. | |
| 5,640,794 | A | 6/1997 | Gardner et al. | |
| 5,655,326 | A | 8/1997 | Levavi et al. | |
| 5,669,169 | A * | 9/1997 | Schmitter | F41A 3/66 89/196 |

(Continued)

*Primary Examiner* — Reginald S Tillman, Jr.

(57) ABSTRACT

A firearm receiver assembly includes a receiver body with a plurality of cavities and a plurality of rails. Each of the plurality of rails is disposed in one of the plurality of cavities. Each of the plurality of rails includes at least one retaining feature for engaging the corresponding cavity.

20 Claims, 15 Drawing Sheets

(56) References Cited

U.S. PATENT DOCUMENTS 5,741,996 A 4/1998 Ruger et al.
5,926,987 A 7/1999 Novak
6,073,380 A 6/2000 Hauser et al.
6,141,895 A 11/2000 Rost et al.
6,374,526 B1 4/2002 Mochak
6,457,271 B1 10/2002 Vaid et al.
6,655,066 B2 12/2003 Fluhr
6,665,973 B1 12/2003 Peev
6,820,606 B1 11/2004 Duffey
6,880,281 B1 4/2005 Orr
7,140,141 B2 11/2006 Vaid
7,194,833 B1 3/2007 Curry
7,243,452 B2 7/2007 Zeh
7,263,796 B2 9/2007 Kellermann et al.
7,516,570 B2 4/2009 Stone
7,617,628 B2 11/2009 Curry
7,703,230 B2 4/2010 Curry et al.
7,810,268 B1 10/2010 McGarry
7,810,269 B2 10/2010 Zukowski et al.
7,861,449 B1 1/2011 Zajk
7,866,077 B2 1/2011 Constant et al.
7,930,848 B2 4/2011 Dye, Jr.
7,958,661 B2 6/2011 Strayer
8,015,742 B2 9/2011 Zedrosser
8,033,043 B2 10/2011 McGarry
8,112,926 B2 2/2012 Beretta
8,117,779 B2 2/2012 Doll et al.
8,122,634 B2 2/2012 Constant et al.
8,191,298 B2 6/2012 Cash et al.
8,220,193 B1 7/2012 Lynch
8,250,799 B2 8/2012 Duperry et al.
8,438,768 B2 5/2013 Kallio
8,459,172 B2 6/2013 Landies et al.
8,505,225 B1 8/2013 Degener
8,572,878 B2 11/2013 Gentilini et al.
8,601,932 B1 12/2013 Karfiol et al.
8,656,619 B2 2/2014 Popikov
8,667,881 B1 3/2014 Hawbaker
8,683,725 B2 4/2014 Munson
8,695,262 B2 * 4/2014 O'Clair ..... F41A 3/12 42/71.02
8,714,145 B2 5/2014 Maeda
8,726,555 B2 5/2014 Carr
8,776,426 B1 7/2014 Symonds
8,820,211 B1 9/2014 Hawbaker
8,863,425 B2 10/2014 Lee
8,893,607 B2 11/2014 Audibert et al.
8,925,232 B2 1/2015 Silveira
8,935,872 B2 1/2015 Zukowski
8,950,311 B2 2/2015 Emde et al.
8,959,818 B2 2/2015 Mayerl
9,062,925 B1 6/2015 Viani
9,194,637 B2 11/2015 Mather
9,303,936 B2 4/2016 Toner
9,395,146 B2 7/2016 Tippmann, Jr.
9,404,700 B1 8/2016 Viani
9,410,758 B1 8/2016 Viani
9,410,760 B2 8/2016 Siddle
9,482,481 B2 11/2016 LaValley et al.
9,541,341 B2 1/2017 Macy
9,587,903 B2 3/2017 Sullivan et al.
RE46,411 E 5/2017 Chu
9,638,484 B1 5/2017 Friend
9,777,980 B2 10/2017 Heizer
9,803,943 B2 10/2017 Schafer et al.
9,952,012 B2 4/2018 Fellows et al.
9,952,013 B2 4/2018 Fellows et al.
9,989,327 B2 6/2018 Horch
10,001,332 B1 6/2018 Friend
10,001,335 B2 6/2018 Patterson et al.
10,101,102 B2 10/2018 Eitan et al.
10,107,580 B2 10/2018 Fellows et al.
10,393,461 B2 8/2019 Fellows et al.
10,401,102 B1 9/2019 Carroll
10,641,571 B2 5/2020 Quinn et al.
10,739,095 B2 8/2020 Underwood et al.
10,801,795 B2 10/2020 Lipowski
10,845,147 B2 11/2020 Fellows et al.
10,912,292 B1 2/2021 Maggiore
11,022,387 B1 * 6/2021 Noonan ..... F41C 3/00
11,280,570 B2 3/2022 Underwood et al.
11,320,221 B2 5/2022 Kastrun
11,421,954 B2 8/2022 Underwood et al.
11,441,859 B2 9/2022 Underwood et al.
11,656,041 B1 * 5/2023 Millard ..... F41A 3/66 42/18
2005/0132627 A1 6/2005 Wossner et al.
2008/0078284 A1 4/2008 Murello
2009/0158634 A1 6/2009 Bubits
2010/0229447 A1 9/2010 Metzger
2010/0287806 A1 11/2010 Marfione et al.
2011/0232148 A1 9/2011 Cain et al.
2011/0271827 A1 11/2011 Larson et al.
2012/0174454 A1 7/2012 Kallio
2012/0180354 A1 7/2012 Sullivan et al.
2014/0215880 A1 8/2014 Zukowski
2014/0311007 A1 10/2014 Capps et al.
2015/0068092 A1 3/2015 Kallio
2015/0219413 A1 8/2015 Karimullah et al.
2015/0253096 A1 9/2015 Lee
2015/0267984 A1 9/2015 Kokinis et al.
2015/0292828 A1 10/2015 Nebeker et al.
2015/0308784 A1 10/2015 Cho
2015/0362274 A1 12/2015 Merlino et al.
2016/0033218 A1 2/2016 Folkestad et al.
2016/0047614 A1 2/2016 Larson, Jr.
2016/0131449 A1 5/2016 Horch
2016/0178303 A1 6/2016 Macy
2016/0178304 A1 6/2016 Geissele
2016/0187090 A1 6/2016 Mather et al.
2016/0187092 A1 6/2016 Mather et al.
2016/0377364 A1 12/2016 Santos Reis
2017/0003093 A1 1/2017 Spinner et al.
2017/0184366 A1 6/2017 Zajk et al.
2017/0268843 A1 9/2017 Heizer
2017/0328663 A1 11/2017 Fellows et al.
2018/0112944 A1 4/2018 Underwood et al.
2019/0271524 A1 9/2019 Khoshnood
2020/0217604 A1 * 7/2020 Borges ..... F41A 11/02
2020/0292266 A1 9/2020 Underwood et al.
2020/0340769 A1 10/2020 Underwood et al.
2021/0247157 A1 8/2021 Lesenfants
2021/0270551 A1 9/2021 Underwood et al.
2021/0348867 A1 11/2021 Reynolds et al.
2022/0034615 A1 2/2022 Fellows et al.
2022/0120526 A1 4/2022 Kim
2022/0170711 A1 6/2022 Underwood et al.
2022/0307788 A1 9/2022 Bender
2022/0357122 A1 11/2022 Niswander et al.
2022/0364812 A1 11/2022 Fellows
2022/0364813 A1 11/2022 Underwood et al.
2023/0143657 A1 5/2023 Underwood et al.
2024/0060740 A1 2/2024 Underwood et al.

* cited by examiner

FIREARM RECEIVER ASSEMBLIES

CROSS REFERENCE TO RELATED APPLICATIONS

This application is related to and claims priority benefit from U.S. Provisional Application No. 63/548,299 ("the '299 application"), filed on Nov. 13, 2023 and U.S. Provisional Application No. 63/558,759 ("the '759 application"), filed on Feb. 28, 2024. The '299 application and the '759 application are each hereby incorporated in their entirety by this reference.

FIELD OF THE INVENTION

The field of the invention relates to firearm receiver assemblies for firearms, particularly receiver assemblies designed for handguns.

BACKGROUND

Many modern firearms and firearm accessories (including handguns, rifles, carbines, shotguns, etc.) are designed based on existing modular firearm systems. For example, many firearms and related accessories are designed for compatibility with existing handgun platforms. Many of these products follow traditional designs based on industry standards and/or military specification (milspec). However, many of the existing components are not optimized for different or multiple materials, and require labor-intensive construction and assembly techniques.

To increase comfort and convenience for a greater number of operators, it may be desirable to design new firearm components or accessories. Manufacturing methods utilizing multiple materials to create hybrid parts facilitate the use of specialized materials that more efficiently distribute and dissipate energy while better absorbing vibration and reducing weight for the firearm. Such designs may result in modular firearm components or accessories that increase reliability, reduce perceived recoil, increase safety, and reduce manufacturing/assembly costs.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments of the present invention, a firearm receiver assembly comprises: a receiver body comprising a plurality of cavities; and a plurality of rails, wherein: each of the plurality of rails is disposed in one of the plurality of cavities; and each of the plurality of rails comprises at least one retaining feature.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-16 illustrate components of firearms, the features, concepts, and functions described herein are also applicable (with potential necessary alterations for particular applications) to handguns, semiautomatic, automatic, rifles, carbines, pistols, shotguns, or any other type of firearm.

Figure 15:
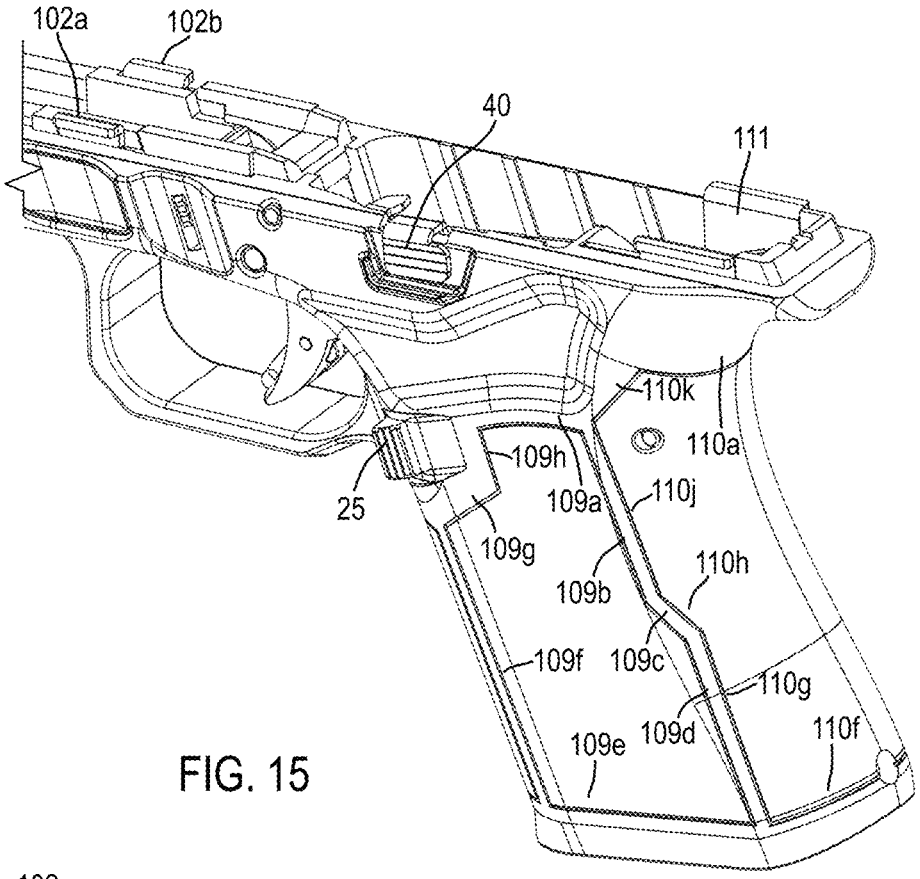
FIG. 15 is a partial perspective view of a firearm with a firearm receiver assembly according to certain embodiments of the present invention.
Figure 16:
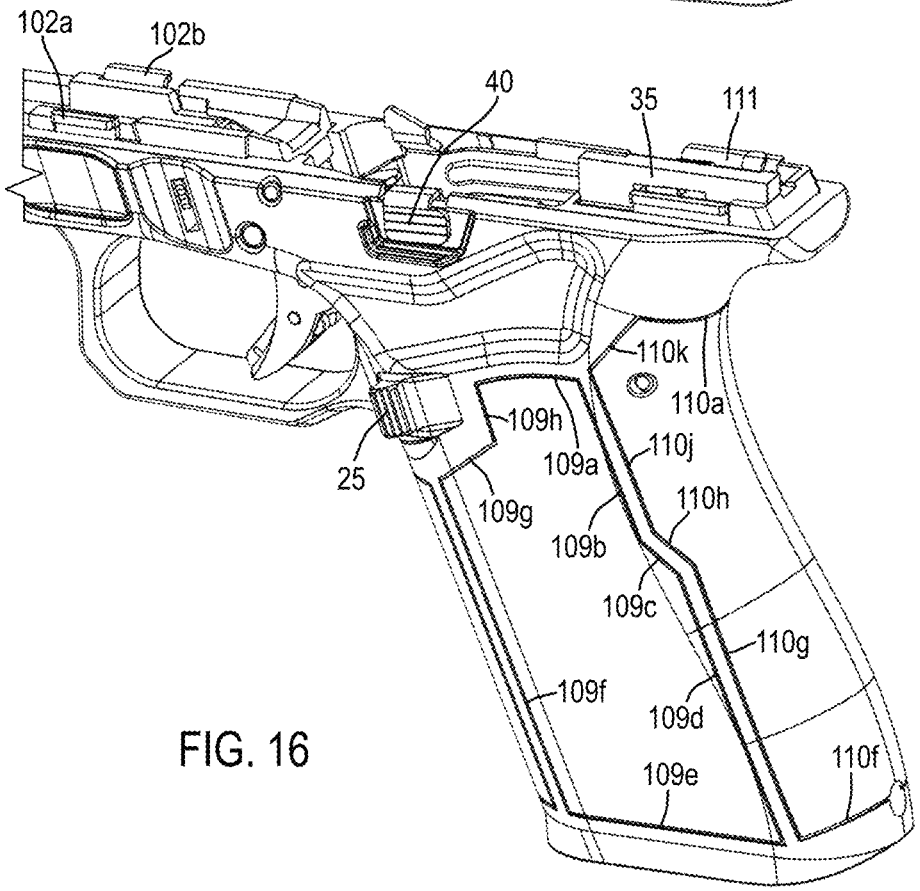
FIG. 16 is a partial perspective view of a firearm with a firearm receiver assembly according to certain embodiments of the present invention.

In some embodiments, a firearm receiver assembly 100 may attach to or be a component of a firearm 10. For example, as shown in FIGS. 1A, 1B, 8A, and 8B, the firearm receiver assembly 100 may be attached to a slide assembly 11 such that a magazine 20 may be inserted into the firearm receiver assembly 100. The slide assembly 11 may include a front sight 13 and a rear sight 14. In some embodiments, the firearm receiver assembly 100 includes a receiver body 101. For interfacing with various portions of the slide assembly 11, the firearm receiver assembly 100 may include at least one front rail 102, at least one rear rail 111, a locking block 16, a trigger assembly 30, a trigger housing 35, a slide catch assembly 40, and/or various relevant components. In some cases, a pin 17 secures the locking block 16 and/or the trigger assembly 30. The trigger assembly 30 may be designed such that at least a portion of the trigger pivots about pin 17. In some embodiments, a pin 18 also secures the locking block 16. The firearm receiver assembly 100 may also include a pin 19 for securing the at least one rear rail 111. As seen in FIGS. 1A-2, 8A, and 8B, the firearm receiver assembly 100 may include a magazine release 25. As shown in FIGS. 15 and 16, the system may be adapted for different size magazines such that some embodiments include a shorter grip for smaller magazines (see FIG. 15) and some embodiments include a longer grip for larger magazines (see FIG. 16).

Figure 1A:
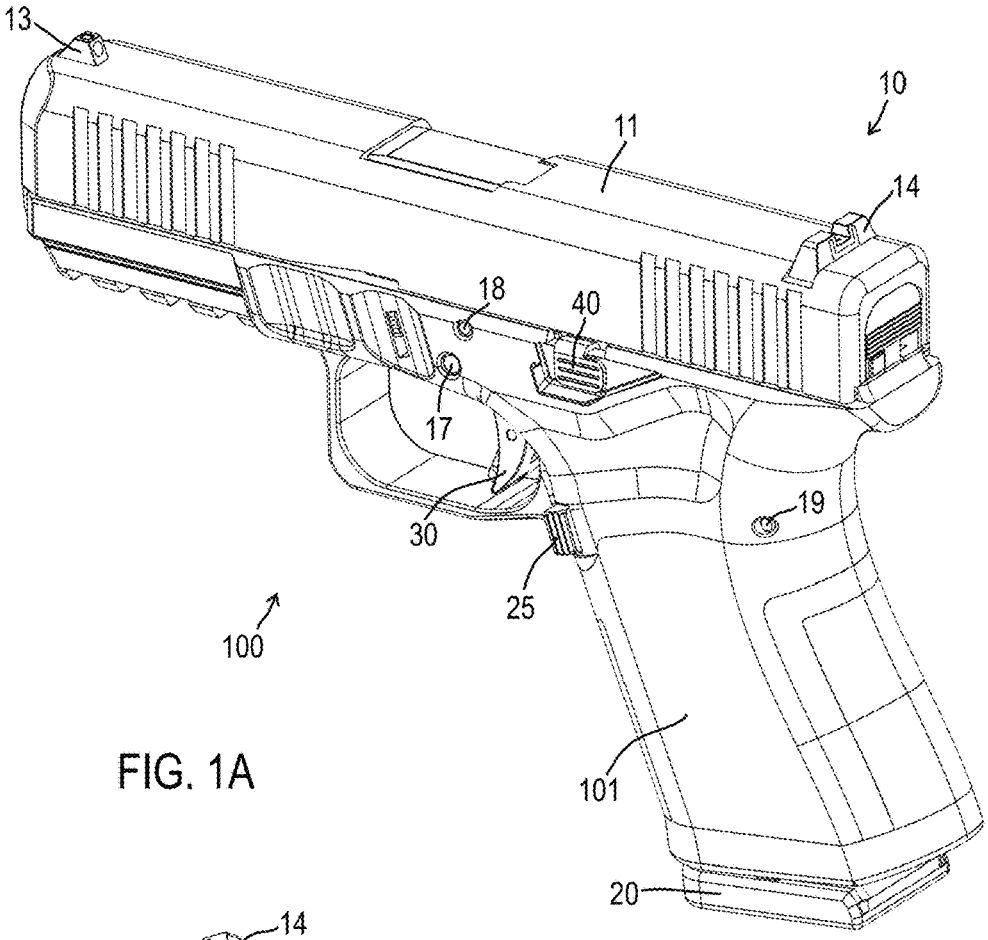
FIG. 1A is a top rear perspective view of a firearm with a firearm receiver assembly according to certain embodiments of the present invention.
Figure 1B:
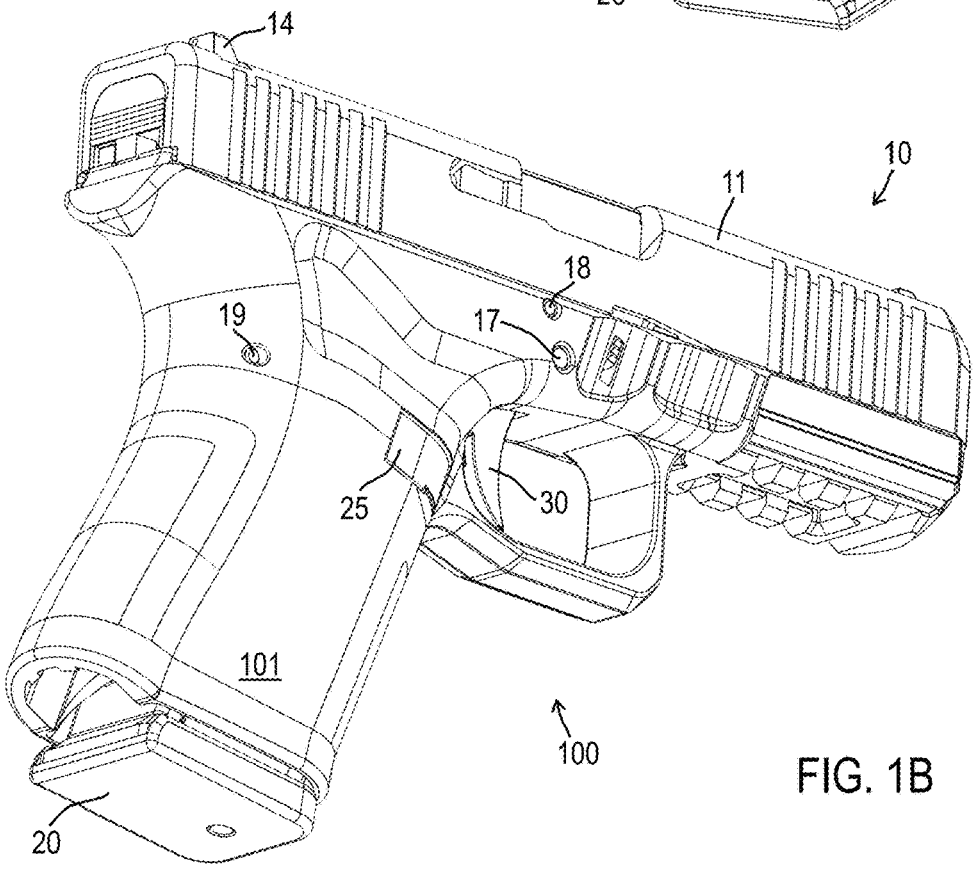
FIG. 1B is a bottom rear perspective view of the firearm of FIG. 1A.
Figure 2:
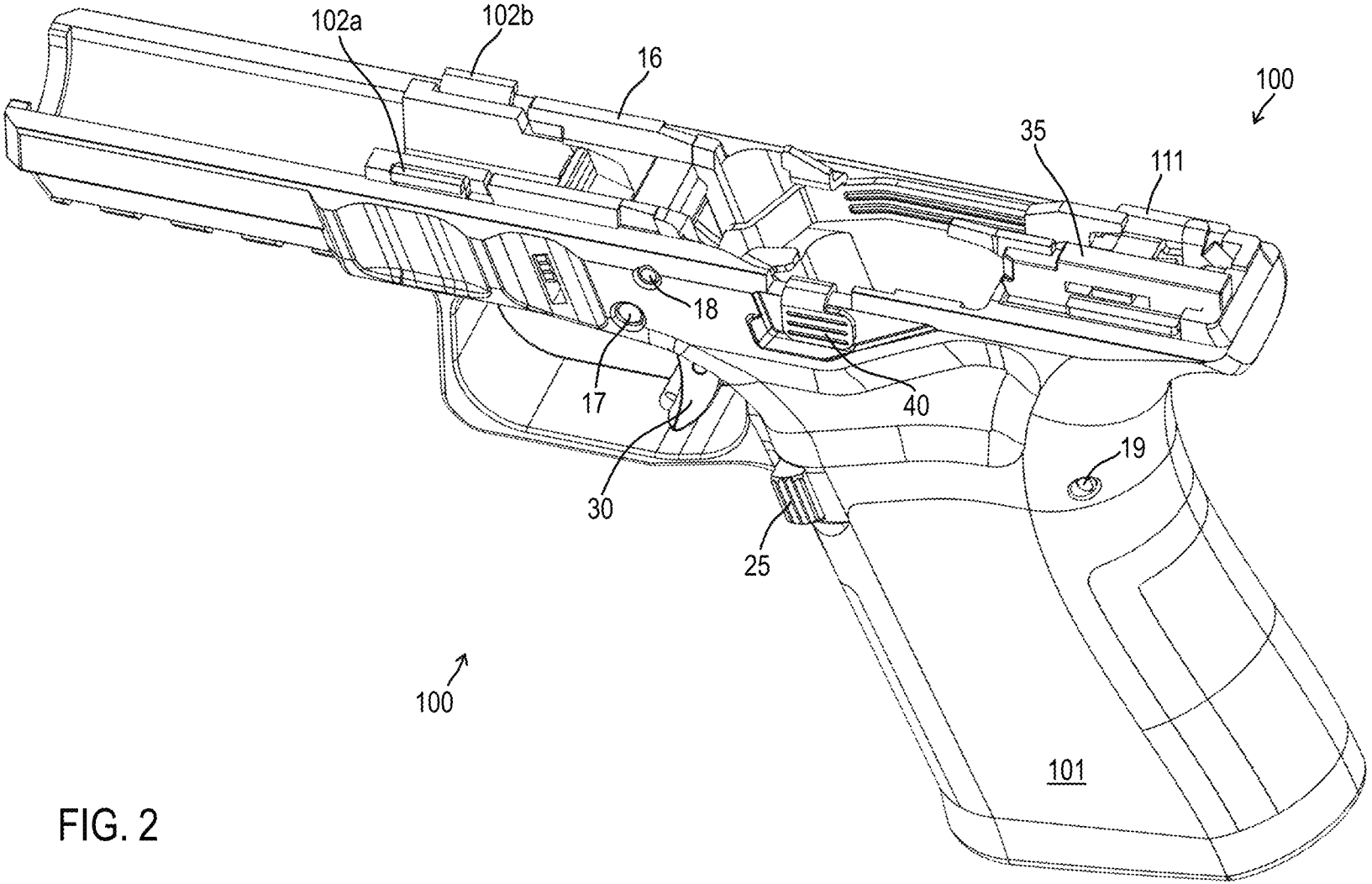
FIG. 2 is a top perspective view of the firearm receiver assembly of FIG. 1A.
Figure 3:
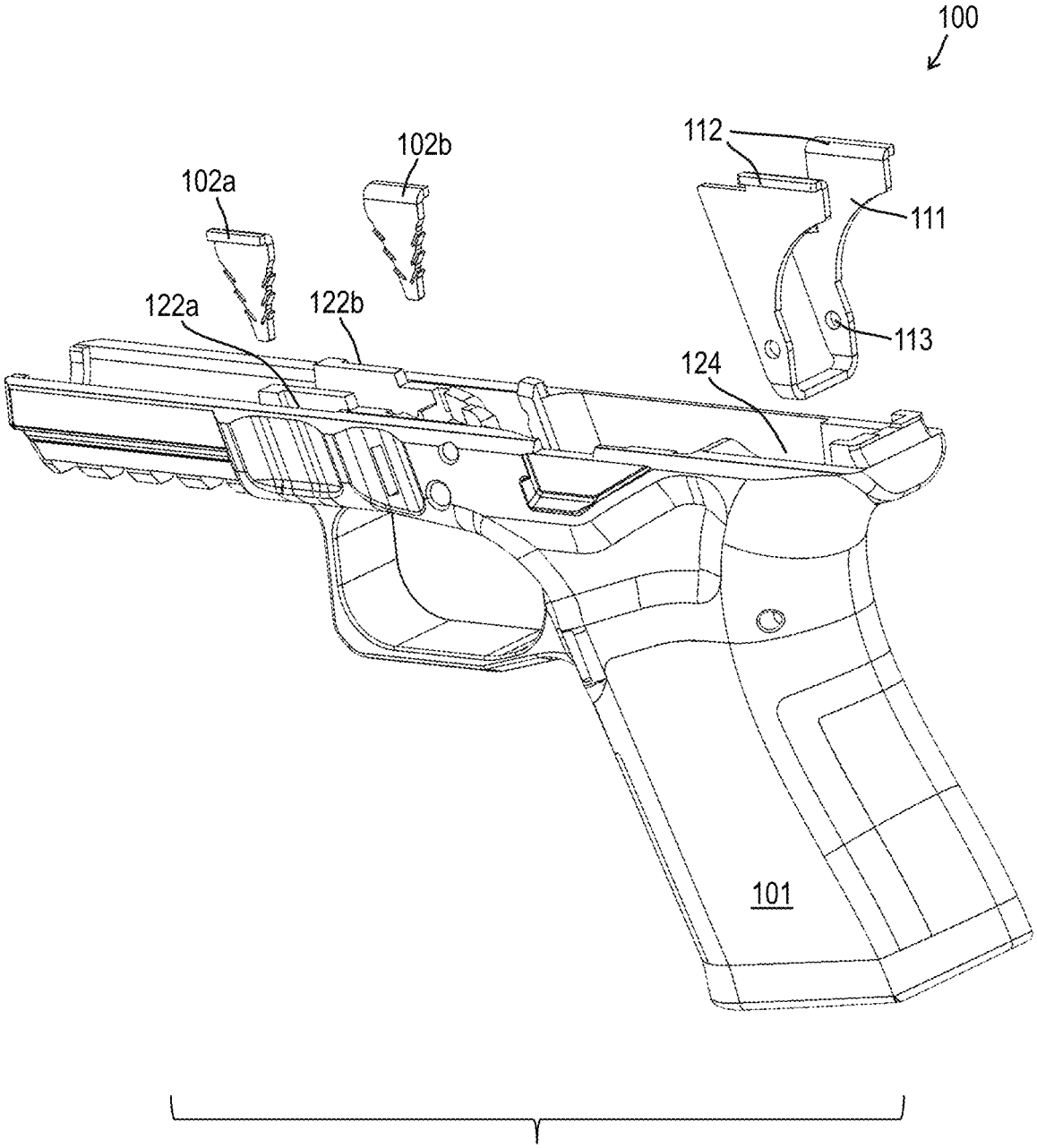
FIG. 3 is an exploded perspective view of the firearm receiver assembly of FIG. 1A.
Figure 4A:
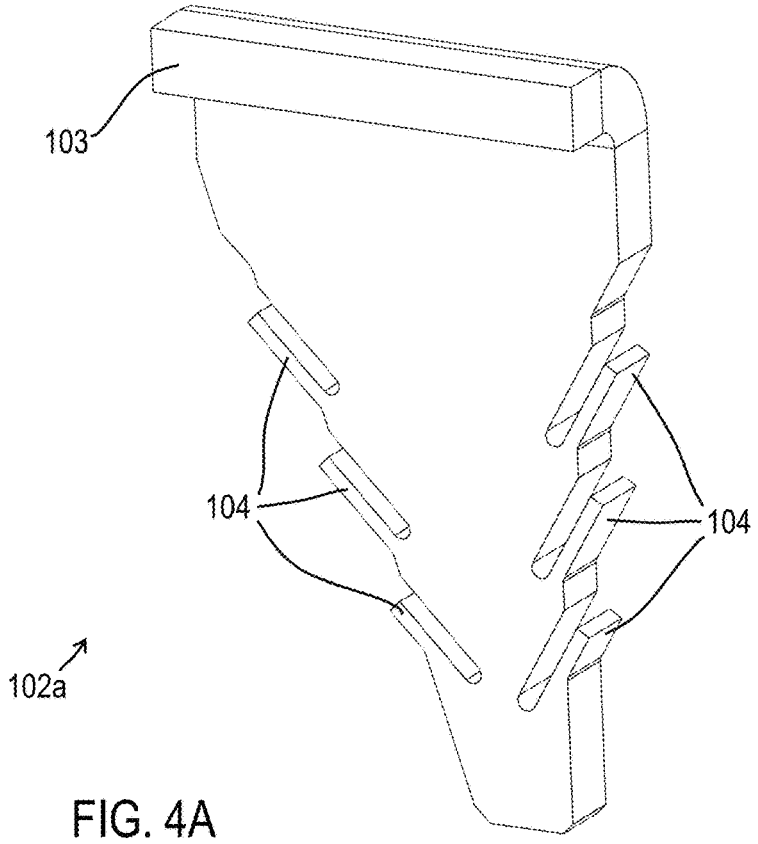
FIG. 4A is a top perspective view of a front rail of the firearm receiver assembly of FIG. 1A.
Figure 4B:
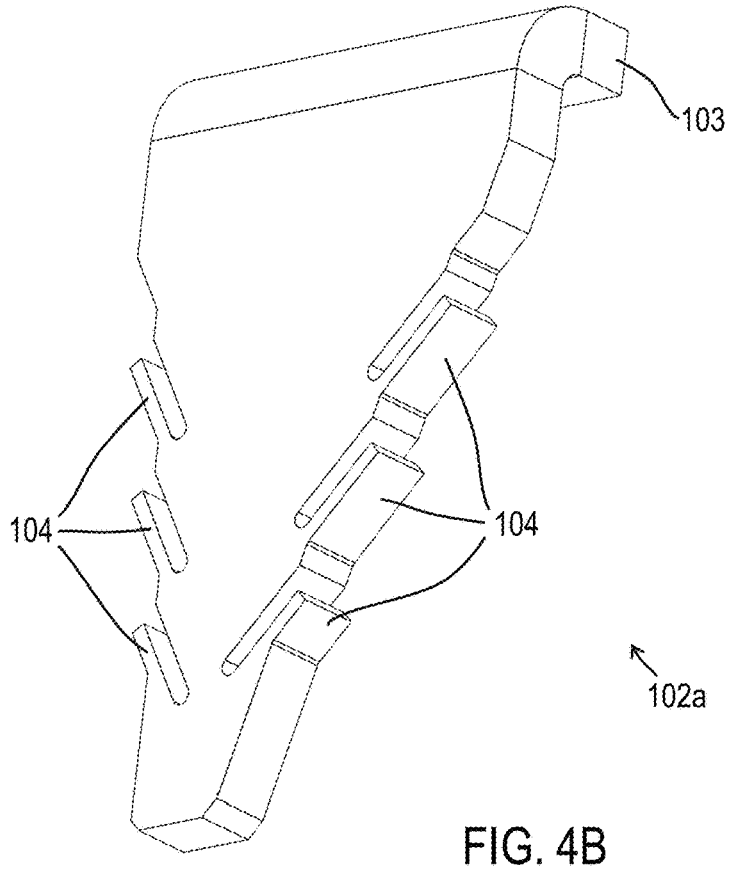
FIG. 4B is a bottom perspective view of a front rail of the firearm receiver assembly of FIG. 1A.
Figure 9:
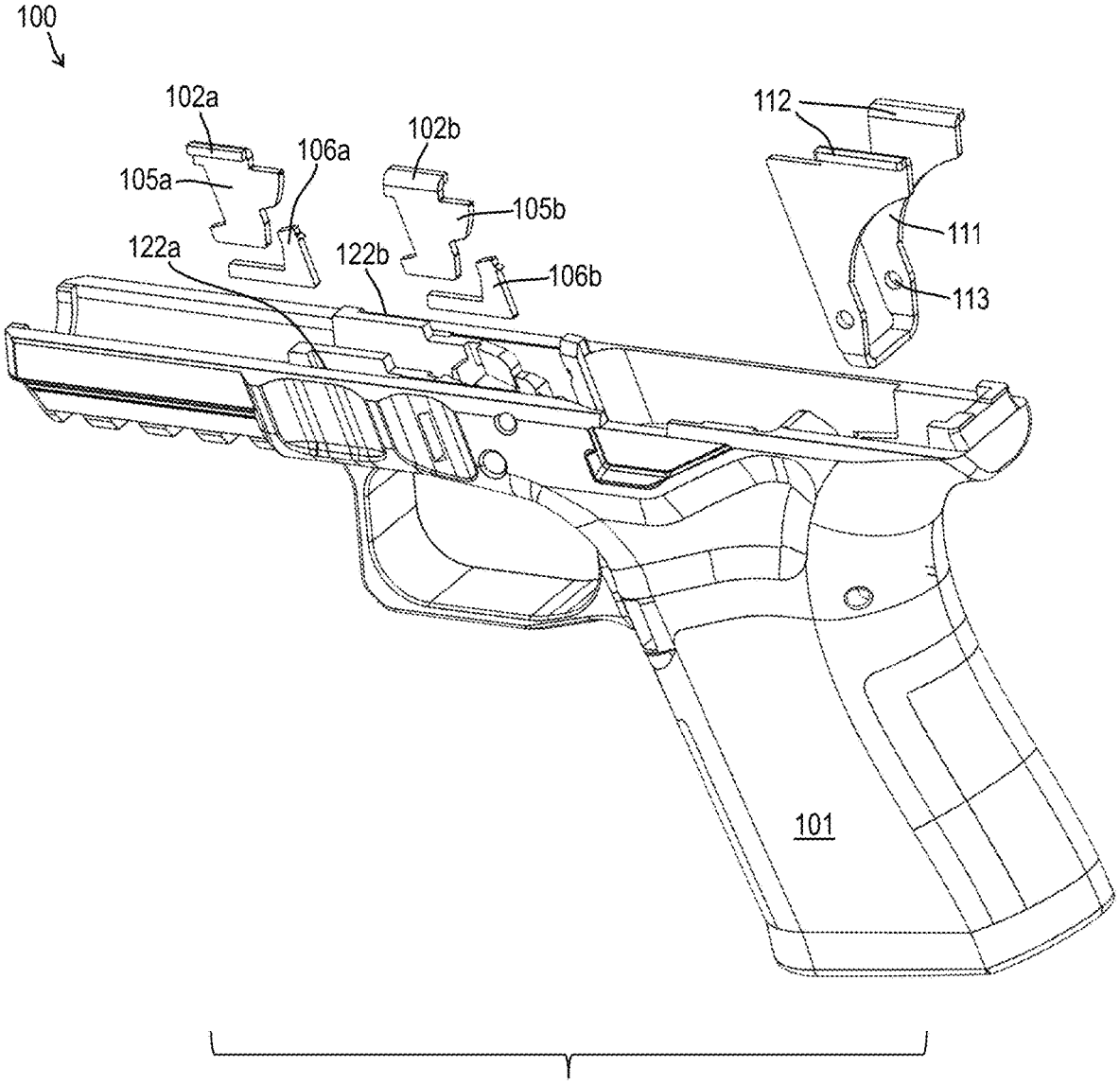
FIG. 9 is an exploded perspective view of the firearm receiver assembly of FIG. 8A.

As shown in FIGS. 2-7 and 9-11B, the at least one front rail 102 includes two separate rails that are independently inserted into the receiver body 101. In some embodiments, the at least one front rail 102 is a single component with an overall U shape similar to the rear rail 111 shown in FIGS. 2, 3, 7, and 9. As shown in FIGS. 3 and 9, in some cases, a front left rail 102*a* is inserted into cavity 122*a* of the receiver body 101 and a front right rail 102*b* is inserted into cavity 122*b* of the receiver body 101. Each rail 102 may include at least one slide interface portion 103 at or near the top of the rail 102 and at least one retaining feature 104. Although not shown in the drawings, each rail 102 may include a hole that extends through some or all portions such that the hole is designed to interface with a pin (similar to hole 113 for the rear rail 111).

Figure 5A:
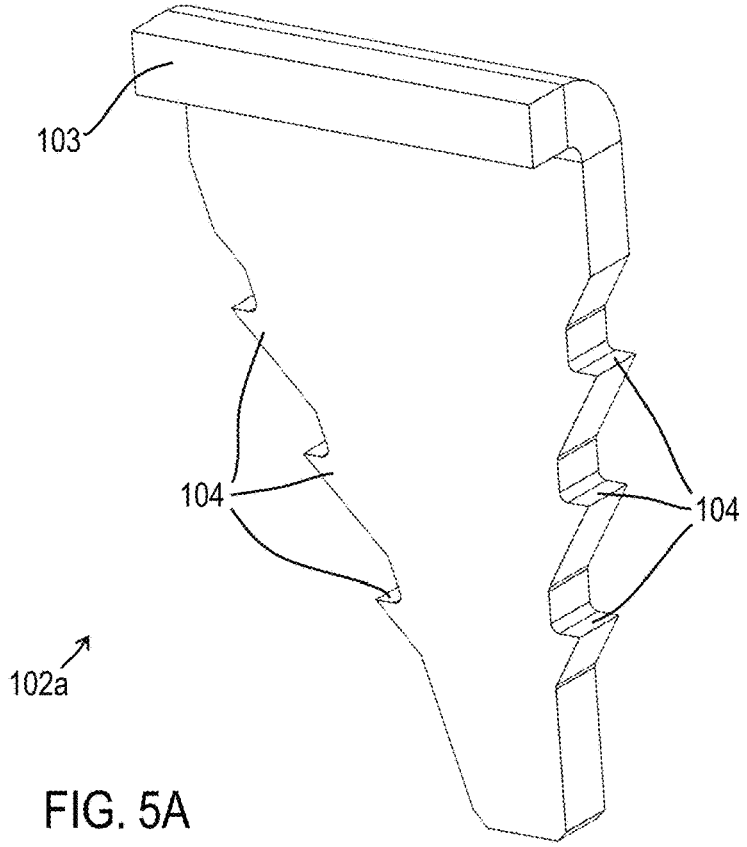
FIG. 5A is a top perspective view of a front rail of the firearm receiver assembly of FIG. 1A.
Figure 5B:
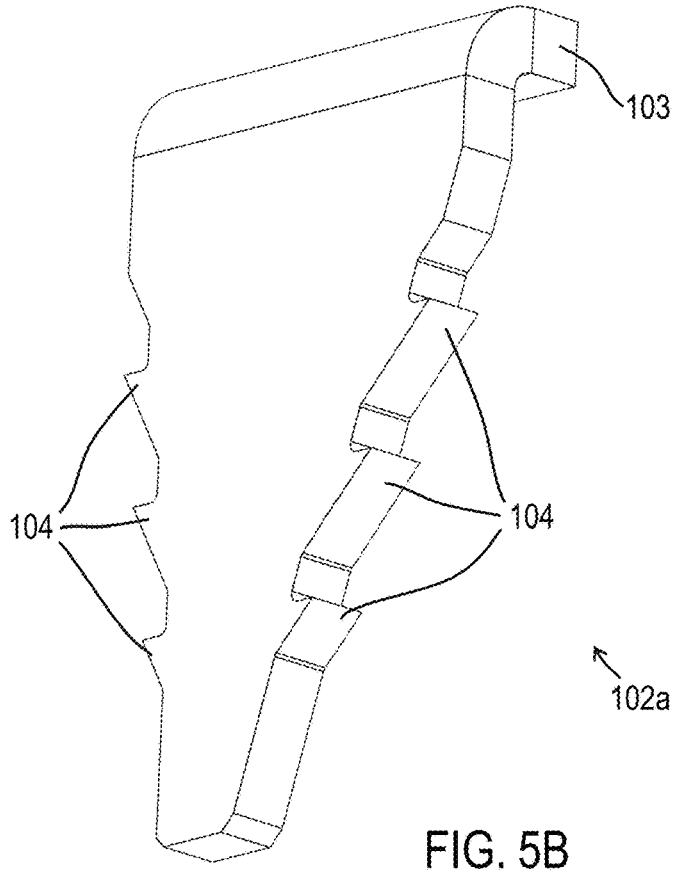
FIG. 5B is a bottom perspective view of a front rail of the firearm receiver assembly of FIG. 1A.

In some embodiments, the retaining feature(s) 104 function to secure the corresponding front rail 102 relative to the receiver body 101. As shown in FIGS. 4A-5B, the retaining feature(s) 104 may include protrusions or barbs that engage and/or penetrate a portion of the receiver body 101 (i.e., the interior of the appropriate cavity 122). This means that the retaining feature(s) 104 may be an integral feature of the respective front rail 102. For example, after the receiver body 101 is manufactured, the front rail 102 may be inserted into the receiver body 101 such that the retaining feature(s) 104 secure or lock the front rail 102 in the appropriate position. Conventional systems often use a pin to lock a front rail in position. In some embodiments, the retaining feature(s) 104 are designed to function in a single direction such that the front rail 102 can be inserted but cannot be removed after installation. In other words, the retaining feature(s) 104 may ensure that installation of the front rail 102 is permanent and irreversible. In some cases, the retaining feature(s) 104 require that any attempt to uninstall the corresponding front rail 102 would require cutting, severing, and/or machining of the receiver body 101 such that the receiver body 101 would be unusable after removal of the front rail 102. For the embodiments illustrated in FIGS. 4A and 4B, the retaining feature(s) 104 may deflect or bend during installation of the front rail 102. However, any attempt to pull the front rail 102 out of cavity 122 would cause the end of each retaining feature 104 to dig, poke, or otherwise engage the interior of the cavity 122. Similarly, due to their geometry, the retaining feature(s) 104 for the embodiments illustrated in FIGS. 5A and 5B would dig, poke, or otherwise engage the interior of the cavity 122 during any attempt to pull the front rail 102 out of cavity 122. In some embodiments, the retaining feature(s) 104 illustrated in FIGS. 5A and 5B are less likely to deflect than the retaining feature(s) 104 illustrated in FIGS. 4A and 4B.

Figure 6A:
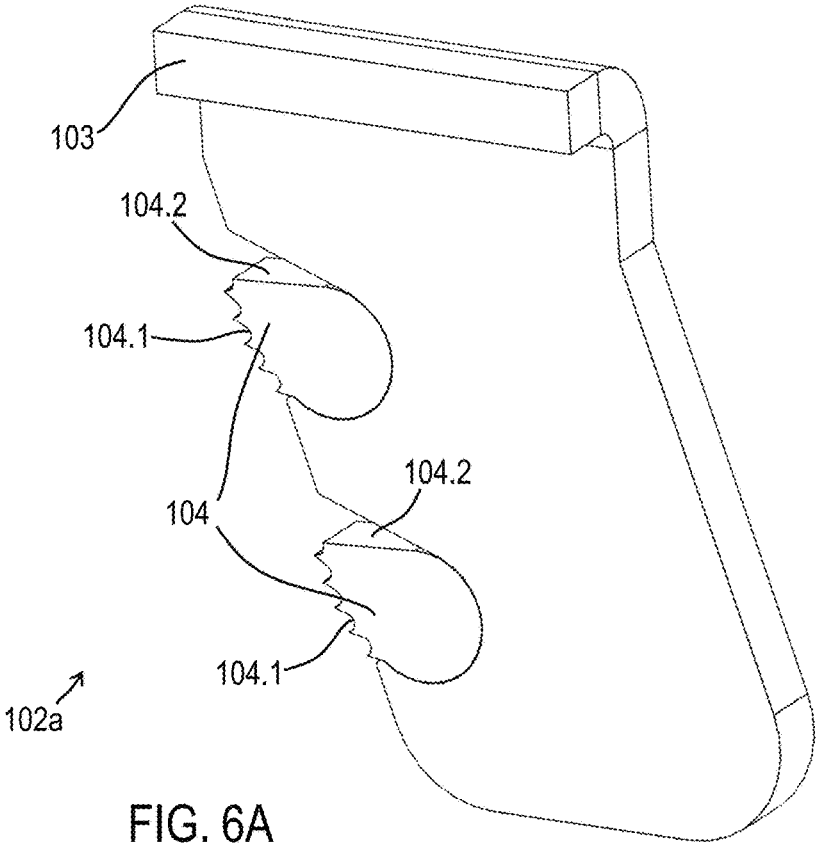
FIG. 6A is a top perspective view of a front rail of the firearm receiver assembly of FIG. 1A.
Figure 6B:
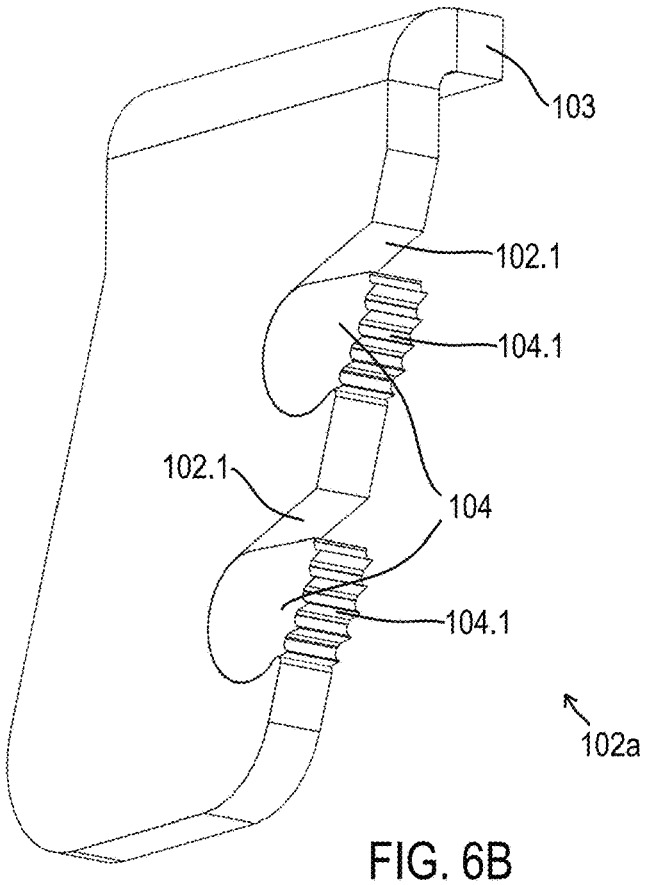
FIG. 6B is a bottom perspective view of a front rail of the firearm receiver assembly of FIG. 1A.
Figure 7:
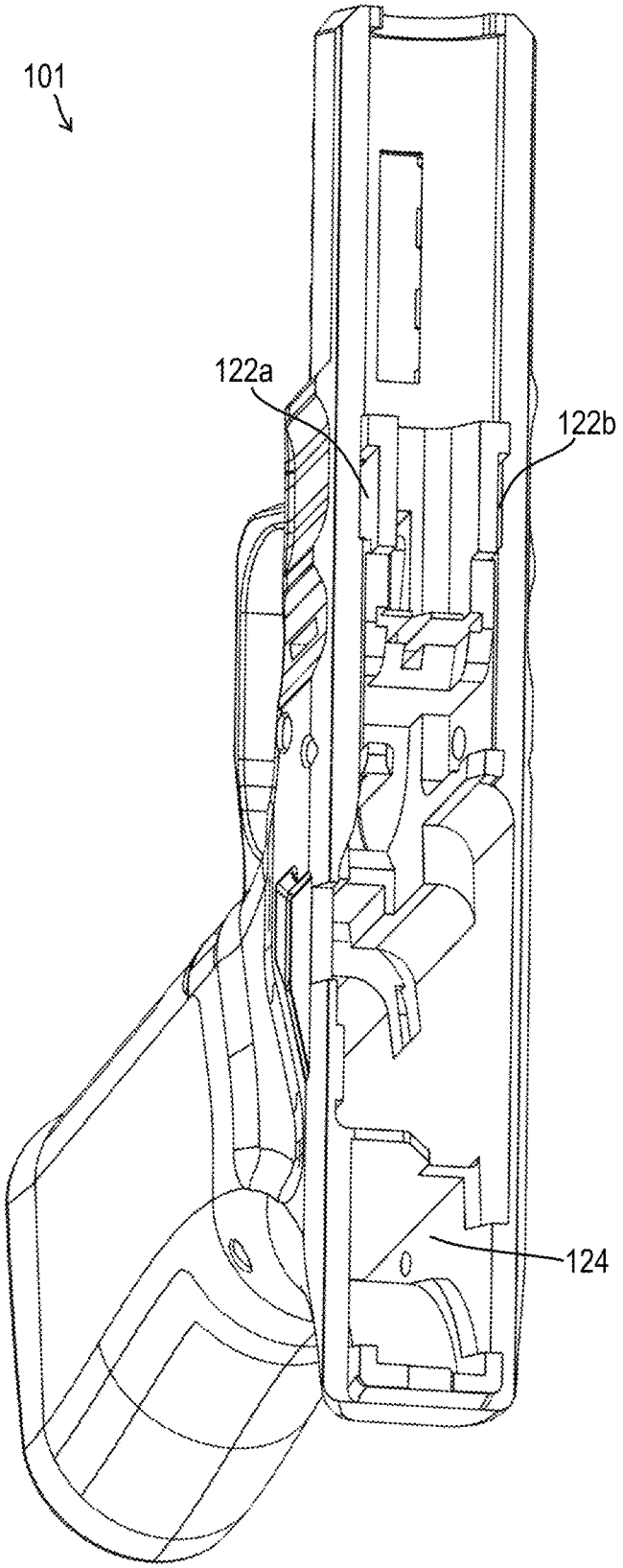
FIG. 7 is a top perspective view of a receiver body of the firearm receiver assembly of FIG. 1A.
Figure 8A:
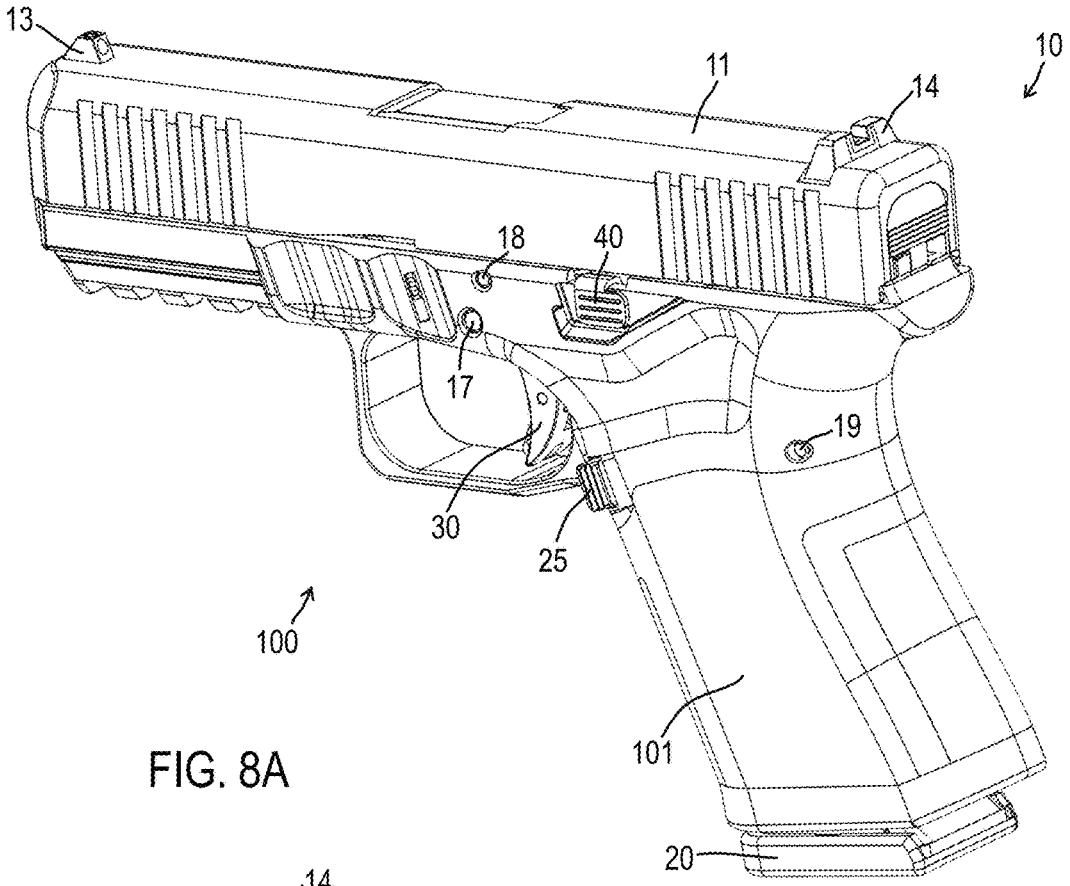
FIG. 8A is a top rear perspective view of a firearm with a firearm receiver assembly according to certain embodiments of the present invention.
Figure 8B:
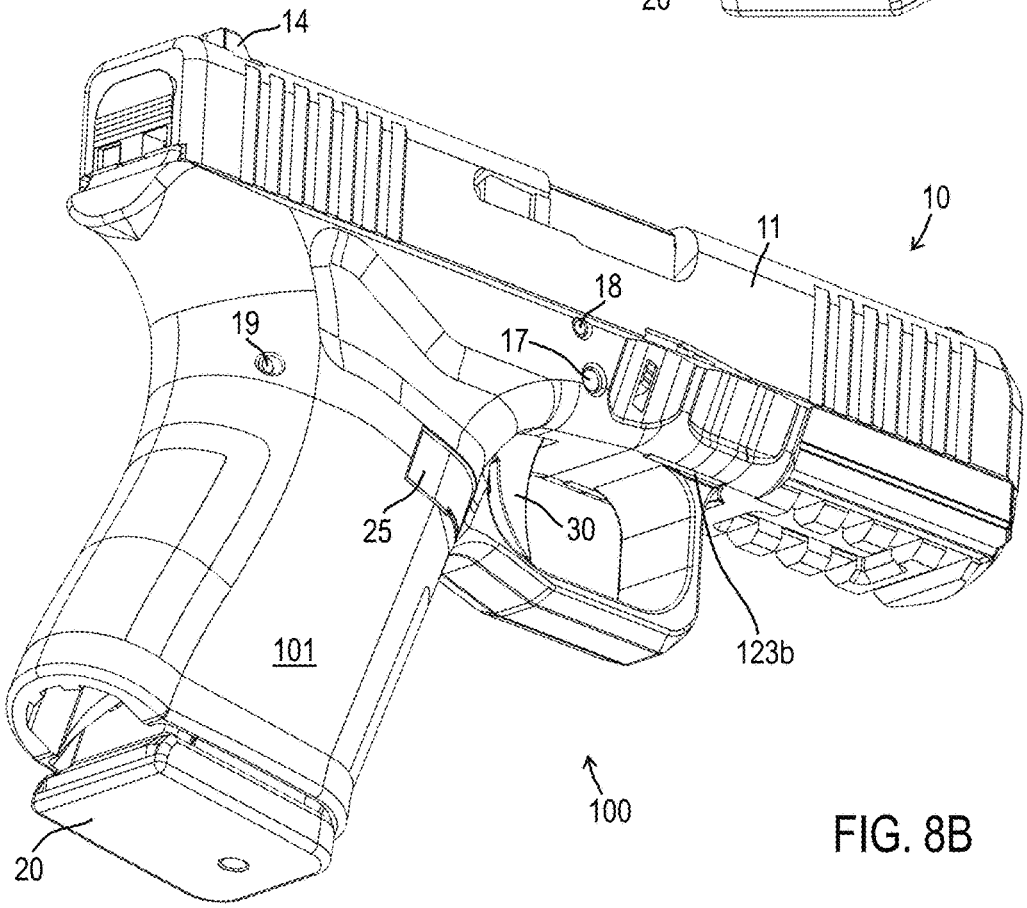
FIG. 8B is a bottom rear perspective view of the firearm of FIG. 8A.

Another option for the retaining feature(s) 104 is illustrated in the embodiments shown in FIGS. 6A and 6B. These retaining feature(s) 104 have an overall disc or cylindrical shape with an asymmetrical portion 104.1 with at least one protrusion or barb for engaging an interior portion of the cavity 122. In some embodiments, the asymmetrical portion 104.1 is a portion that is approximately flat with at least one protrusion or barb. During installation into the receiver body 101, the at least one retaining feature 104 would rotate or pivot relative to the front rail 102. For example, for the embodiment illustrated in FIG. 6A, the two retaining features 104 would rotate clockwise as the front rail 102 is pushed into the cavity 122. In some embodiments, the retaining feature 104 would rotate until a flat portion 104.2 of the retaining feature 104 presses against a corresponding flat portion 102.1 of the front rail 102. However, any attempt to pull the front rail 102 out of cavity 122 would cause the retaining feature(s) 104 to try rotating counter-clockwise which would cause the at least one protrusion or barb of each retaining feature 104 to dig, poke, or otherwise engage the interior of the cavity 122. Although the front rail 102 embodiments shown in FIGS. 6A and 6B include two retaining features 104, the front rail 102 may include any number of retaining features 104 including as few as one or as many as one hundred. The retaining feature(s) 104 are illustrated on one side of the front rail 102 but may be included on both sides.

In some embodiments, at least a portion of each front rail 102 is metallic. For example, the majority of each front rail 102 may be a high strength polymer material (or other non-metal) and the at least one slide interface portion 112 may be metallic. In some cases, the at least one slide interface portion 103 may be over-molded or co-molded such that the interface portion 103 is permanently attached to the other portions of the front rail 102. In other embodiments, each front rail 102 is a single sheet metal component that is bent from a flat pattern. In some embodiments, each front rail 102 is a single polymer component designed for high strength and high temperature capability. Each front rail 102 may be thermoplastic, carbon composite, plastic, nylon, polyethylene, polyetherimide, polypropylene, polyvinyl chloride, steel, aluminum, stainless steel, titanium, high strength aluminum alloy, other plastic or polymer materials, other metallic materials, other composite materials, or other similar materials. Similarly, the receiver body 101 (and thus each cavity 122) may be at least one of thermoplastic, carbon composite, plastic, nylon, polyethylene, polyetherimide, polypropylene, polyvinyl chloride, steel, aluminum, stainless steel, titanium, high strength aluminum alloy, other plastic or polymer materials, other metallic materials, other composite materials, or other similar materials. In some embodiments, the receiver body 101 is the same material as each front rail 102 while in other embodiments, these components are different materials. In some embodiments, the receiver body 101 is at least one of thermoplastic, carbon composite, plastic, nylon, polyethylene, polyetherimide, polypropylene, polyvinyl chloride, ethylene propylene diene monomer rubber, other plastic or polymer materials, other composite materials, or other similar materials.

The at least one rear rail 111, as shown in FIGS. 2, 3, 7, 9, and 12A-13B, may be a single component that is inserted into cavity 124 of the receiver body 101. As shown in FIGS. 3, 9, 13A, 13B, 15, and 16, the rear rail 111 may have an overall U shape with at least one slide interface portion 112 at or near the top of the rear rail 111 such that the rear rail 111 may be adjacent to the trigger housing 35. In some cases, the overall shape of the rear rail 111 is symmetric with two slide interface portions 112. Each slide interface portion 112 may include a perpendicular, angled, and/or bent portion designed to interface with the slide assembly 11. The rear rail 111 may include a hole 113 that extends through some or all portions such that the hole 113 is designed to interface with pin 19. In some embodiments, at least a portion of the rear rail 111 is metallic. For example, the majority of the rear rail 111 may be a high strength polymer material (or other non-metal) and the at least one slide interface portion 112 may be metallic. In some cases, the at least one slide interface portion 112 may be over-molded or co-molded such that the interface portion 112 is permanently attached to the other portions of the rear rail 111. In other embodiments, the rear rail 111 is a single sheet metal component that is bent from a flat pattern. In some embodiments, the rear rail 111 is a single polymer component designed for high strength and high temperature capability. The rear rail 11 may be thermoplastic, carbon composite, plastic, nylon, polyethylene, polyetherimide, polypropylene, polyvinyl chloride, steel, aluminum, stainless steel, titanium, high strength aluminum alloy, other plastic or polymer materials, other metallic materials, other composite materials, or other similar materials. Similarly, the receiver body 101 (and thus each cavity 124) may be at least one of thermoplastic, carbon composite, plastic, nylon, polyethylene, polyetherimide, polypropylene, polyvinyl chloride, steel, aluminum, stainless steel, titanium, high strength aluminum alloy, other plastic or polymer materials, other metallic materials, other composite materials, or other similar materials. In some embodiments, the receiver body 101 is the same material as the rear rail 111 while in other embodiments, these components are different materials. In some embodiments, the receiver body 101 is at least one of thermoplastic, carbon composite, plastic, nylon, polyethylene, polyetherimide, polypropylene, polyvinyl chloride, ethylene propylene diene monomer rubber, other plastic or polymer materials, other composite materials, or other similar materials.

Figure 13A:
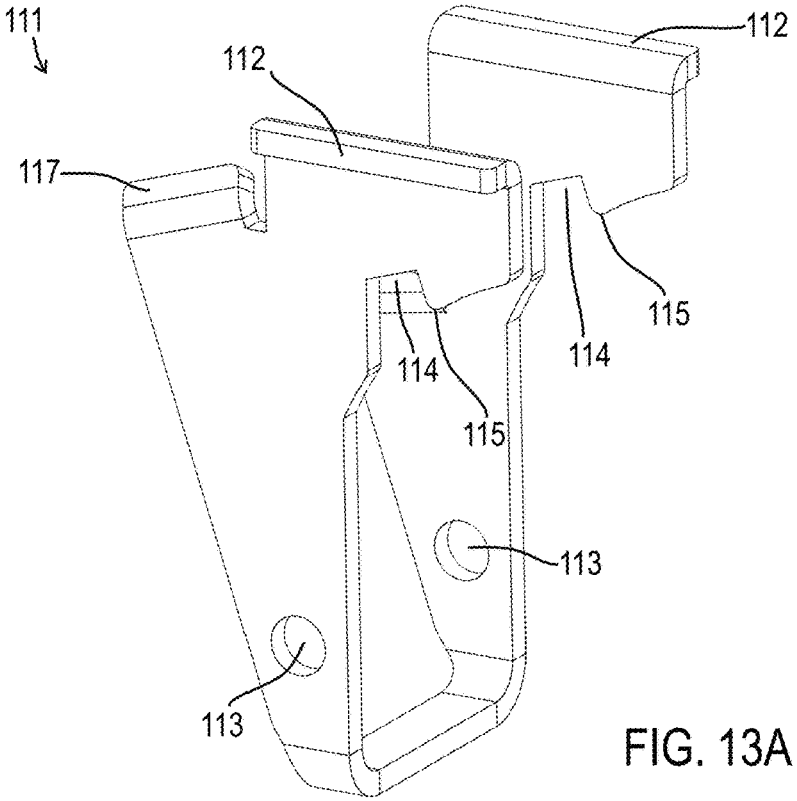
FIG. 13A is a top rear perspective view of a rear rail assembly of the firearm receiver assembly of FIG. 12A.
Figure 13B:
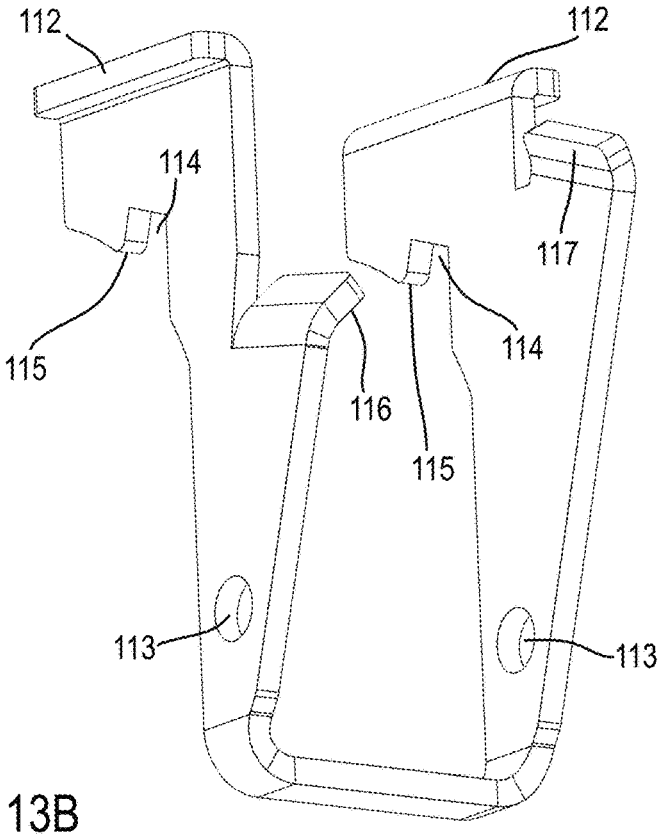
FIG. 13B is a bottom front perspective view of the rear rail assembly of FIG. 13A.
Figure 14:
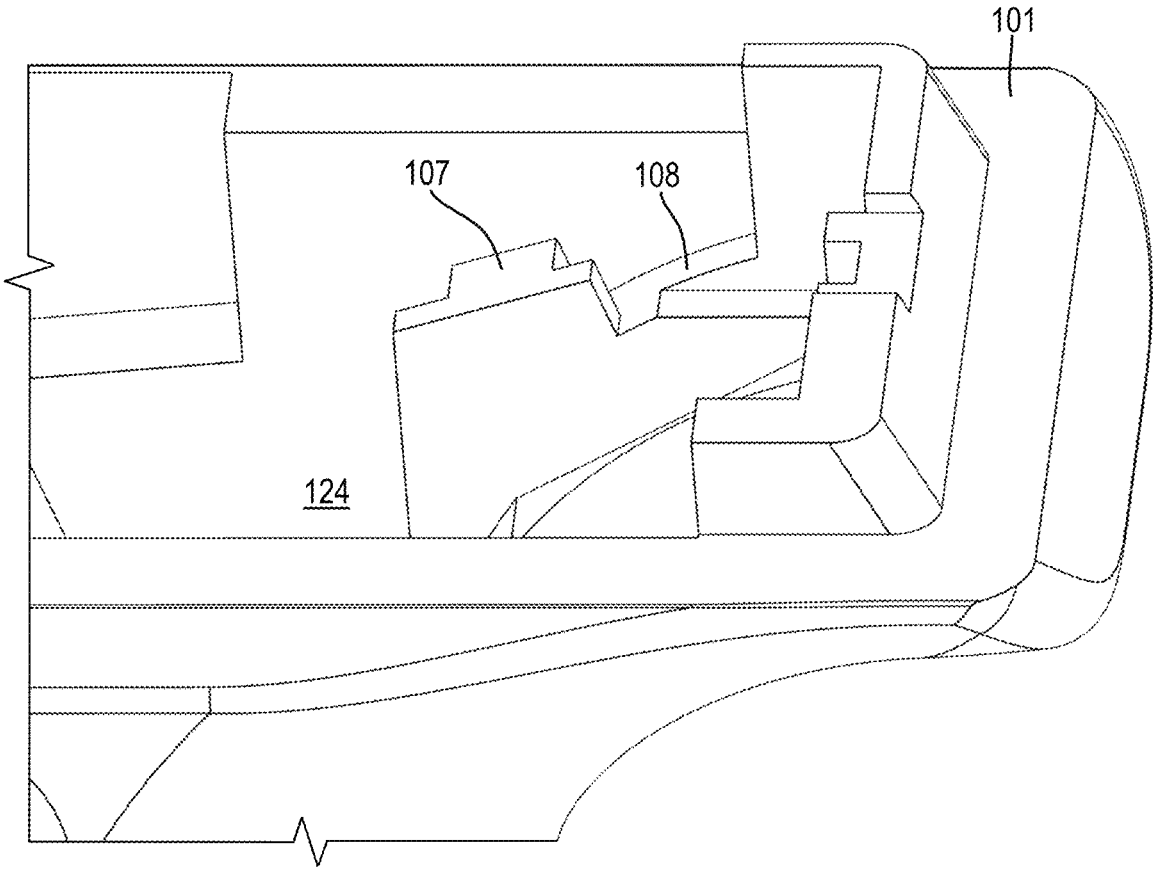
FIG. 14 is a top partial perspective view of a receiver body of the firearm receiver assembly of FIG. 12A.

In some embodiments, as shown in FIGS. 13A and 13B, the rear rail 111 may include stabilizing feature where the stabilizing feature is a notch 114 and/or a protrusion 115. The notch 114 may engage a corresponding feature of the receiver body 101 to reduce or eliminate movement (e.g., sliding and/or tilting) of the slide interface portion(s) 112 (in the lateral and/or fore/aft directions). For example, see member 107 of the receiver body 101 in FIGS. 12B and 14. In some embodiments, the protrusion 115 is configured to engage a corresponding recess or groove of the receiver body 101 which can help reduce or eliminate movement (e.g., sliding and/or tilting) of the slide interface portion(s) 112 (in the lateral and/or fore/aft directions). One example of a recess or groove of the receiver body 101 is shown in FIG. 14 as feature 108.

As shown in FIGS. 13A and 13B, the rear rail 111 may include at least one internal interface portion 116, 117. In some embodiments, the rear rail 111 includes a lower internal interface portion 116 and an upper internal interface portion 117 (see FIG. 13B). The lower internal interface portion 116 may be designed to stabilize the trigger housing 35 and prevent this component from moving relative to the receiver body 101 using pressure from the right side of the trigger housing 35. The upper internal interface portion 117 may be designed to stabilize the trigger housing 35 and prevent this component from moving relative to the receiver body 101 using pressure from the left side of the trigger housing 35.

In some embodiments, the receiver body 101 includes multiple materials. For example, the receiver body 101 may include a primary material and a secondary material. The primary material may be a structural material designed for strength, durability, longevity, etc. In some embodiments, the secondary material is designed to improve ergonomics, grip, aesthetics, and/or other relevant factors. In some embodiments, the primary material may be at least one of thermoplastic, carbon composite, plastic, nylon, polyethylene, polyetherimide, polypropylene, polyvinyl chloride, steel, aluminum, stainless steel, titanium, high strength aluminum alloy, other plastic or polymer materials, other metallic materials, other composite materials, or other similar materials. The secondary material may be a softer more compliant material with a lower Shore hardness such as rubber, thermoplastic vulcanizates, ethylene propylene diene monomer rubber, thermoplastic polyurethane, synthetic rubber, thermoplastic elastomer, polypropylene, and/or other similar materials. In some cases, the secondary material may be overmolded or co-molded onto or relative to other portion(s) of the receiver body 101. The receiver body 101 may include specific area (a) for the secondary material. For example, the receiver body 101 may include outlined area(s) 109, 110 as shown in FIGS. 15 and 16. These outlined area(s) may be recessed from other surfaces of the receiver body 101. In some embodiments, at least a portion of the magazine release 25 and/or the slide catch assembly 40 include some of the secondary material. The secondary material may be applied with a constant thickness in some cases. In other cases, the secondary material varies in thickness to create textures and/or features designed to enhance grip. The secondary material may be secured relative to the primary material with one or more mechanical features, including, for example, interlocking feature(s). For example, the edges 109*a-h* and/or edges 110*a-k* may include grooves designed for the secondary material to flow into, which would create a mechanical interlock. In other cases, the secondary material is attached or bonded by other means including, but not limited to, chemically, molecularly, with adhesive, with mechanical fasteners, removably attached, and/or any other relevant means.

As shown in FIGS. 8A-11B, in some embodiments, the front rail(s) 102 may each include multiple components. For example, a left front rail 102*a* may include a first member 105 and a second member 106 where at least one of the members includes at least one retaining feature 104. In some embodiments, the first member 105 and the second member 106 can be inserted together into the corresponding cavity 122. The second member 106 may be a flat plate that includes a "L" shape. In other embodiments, as shown in FIGS. 8B, 10A, and 10B, the receiver body 101 includes at least one cavity 122 that is accessible from above (for inserting the portion of the front rail 102 that includes the slide interface portion 103) but also includes a lower opening 123. For example, the left cavity 122*a* may include left lower opening 123*a* and the right cavity 122*b* may include left lower opening 123*b*. In some embodiments, the second member 106 is inserted through the lower opening 123 to lock the first member 105 into the appropriate position. Similar to the other embodiments for the front rails 102 described above, when the at least one retaining feature 104 (which may include at least one protrusion or barb) digs, pokes, or otherwise engages the interior of the cavity 122, the front rail 102 is permanently and irreversibly inserted into the cavity 122. Although the second member 106 is illustrated with a single retaining feature 104, the second member 106 may include a plurality of retaining features 104 on multiple sides. In addition, the first member 105 may include at least one retaining feature 104 in addition to or in lieu of the retaining feature(s) 104 of the second member 106.

Figure 10A:
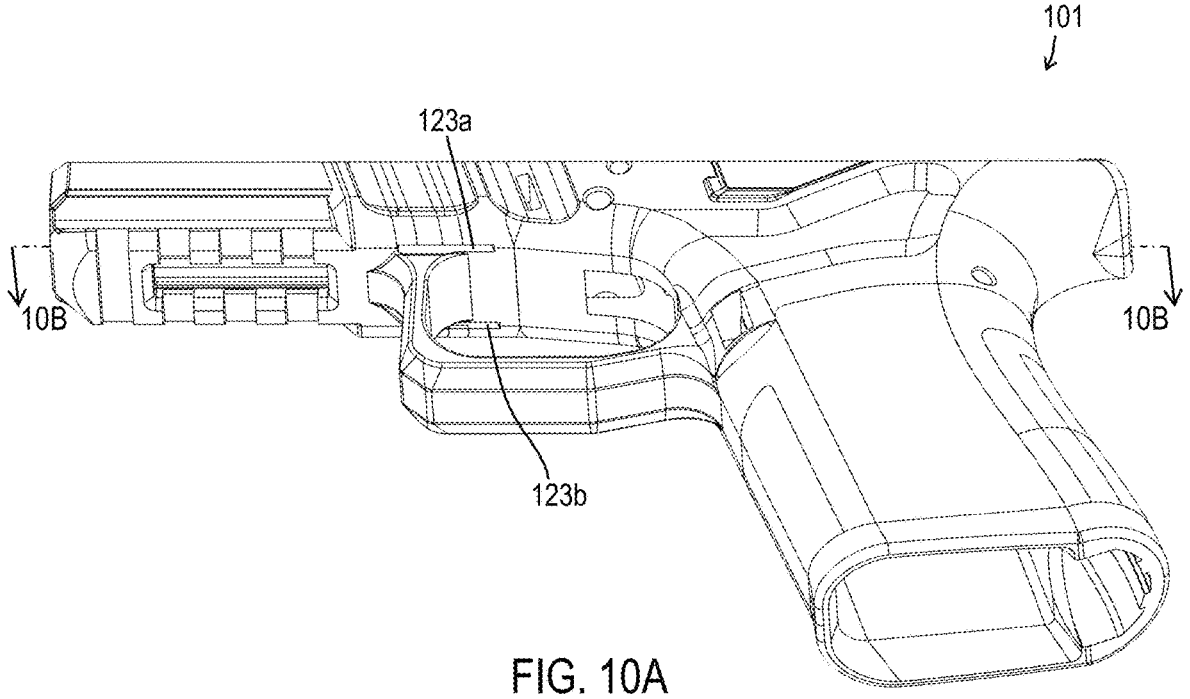
FIG. 10A is a bottom perspective view of the firearm receiver assembly of FIG. 8A.
Figure 10B:
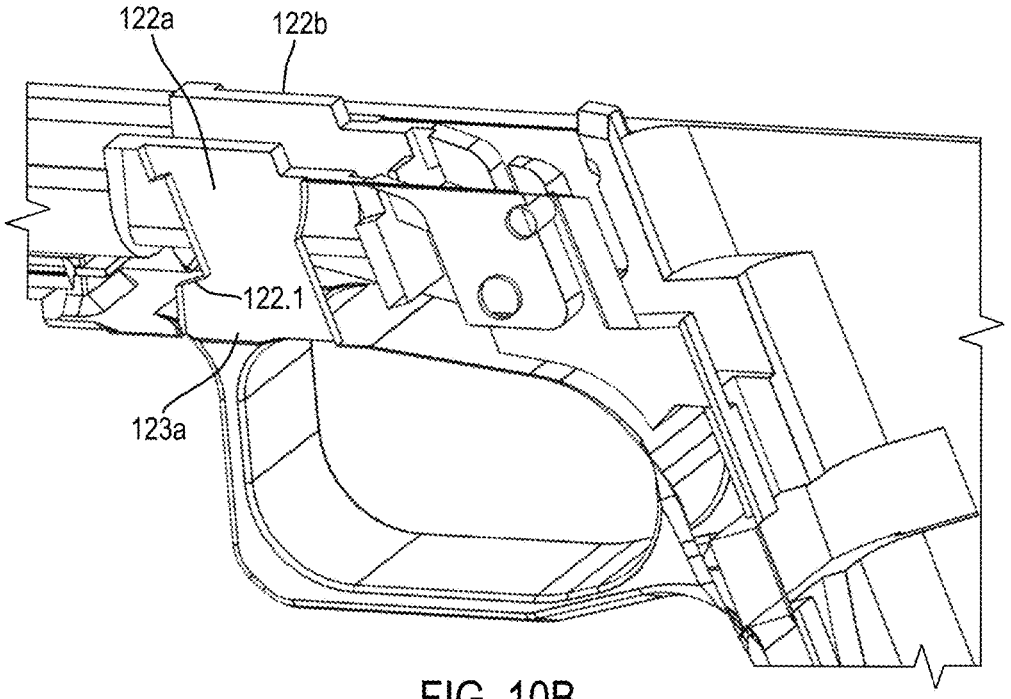
FIG. 10B is a cross-section view of the firearm receiver assembly of FIG. 10A.
Figure 11A:
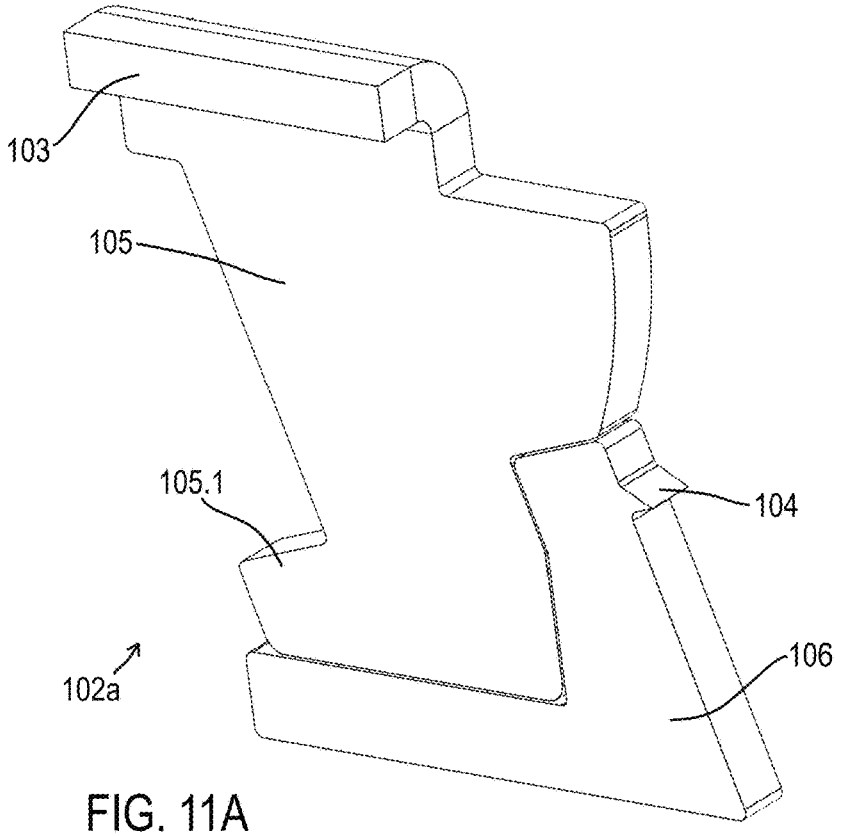
FIG. 11A is a top perspective view of a front rail assembly of the firearm receiver assembly of FIG. 8A.
Figure 11B:
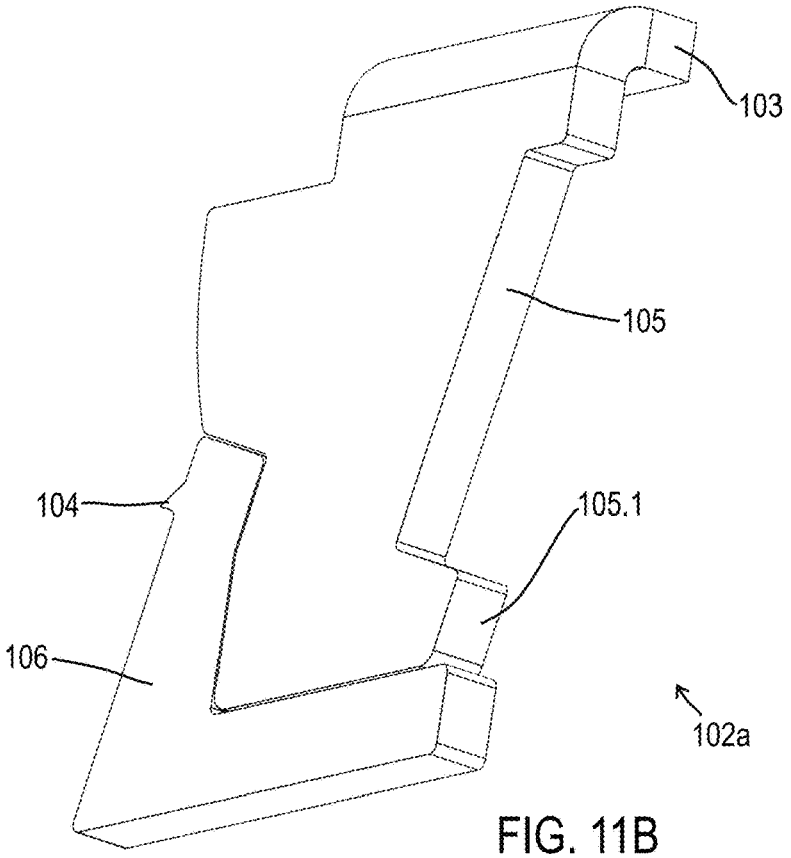
FIG. 11B is a bottom perspective view of a front rail assembly of the firearm receiver assembly of FIG. 8A.
Figure 12A:
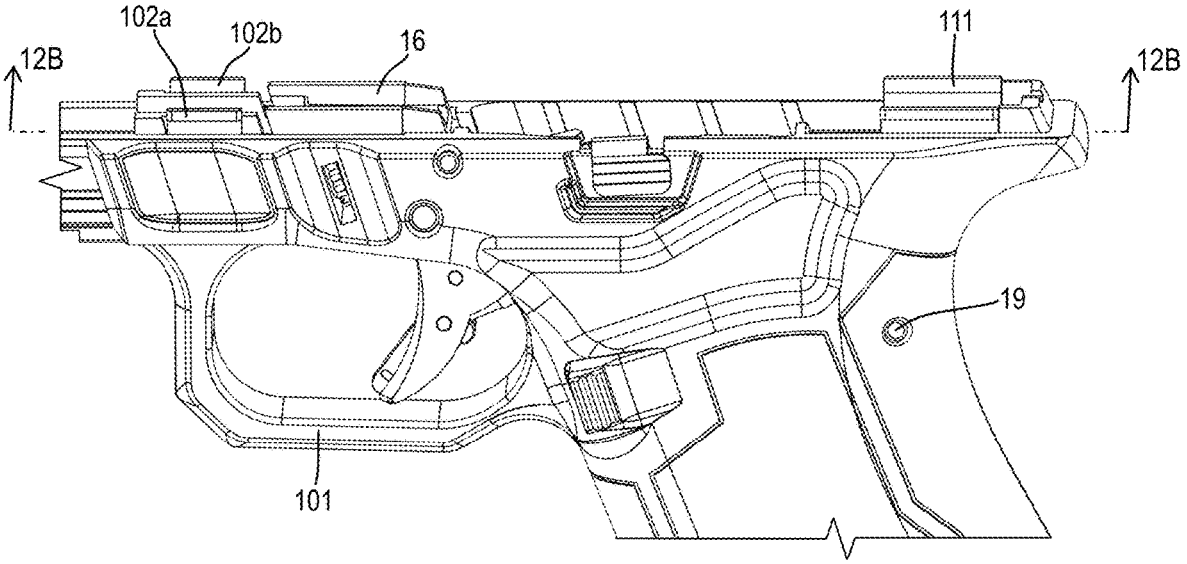
FIG. 12A is a left side partial perspective view of a firearm with a firearm receiver assembly according to certain embodiments of the present invention.
Figure 12B:
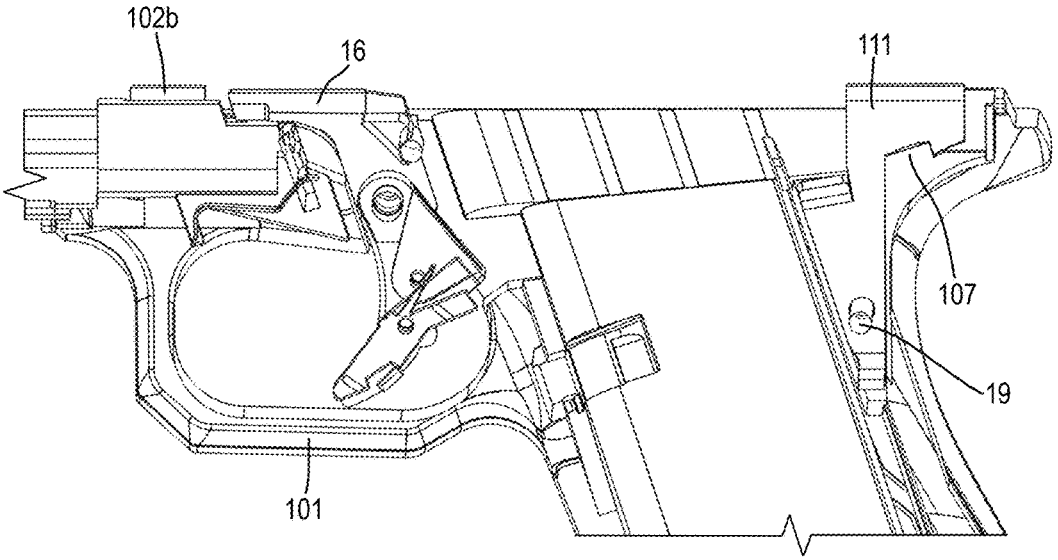
FIG. 12B is a cross-section view of the firearm of FIG. 12A.

In some embodiments, as shown in FIGS. 11A and 11B, the first member 105 includes a lower protrusion 105.1 that is configured to sit under a corresponding feature or shelf in the cavity 122 (e.g., see ledge 122.1 in FIG. 10B). For example, to insert the first member 105 (from above), the first member 105 would need to rotate until pressed sufficiently downward for the lower protrusion 105.1 to slide under ledge 122.1. The subsequent addition of the second member 106 would lock the components in position to prevent rotation of the first member 105 such that the lower protrusion 105.1 will remain secure under ledge 122.1.

Although the illustrated embodiments shown in FIGS. 1-11B illustrate components of handguns, the features, concepts, and functions described herein are also applicable (with potential necessary alterations for particular applications) to semiautomatic, automatic, rifles, carbines, pistols, shotguns, AR-15, AR-10, AR-9, AR-18, AR-180, AK-47, AK-74, AKM, SCAR, and any other appropriate firearm.

The components of any of the components described herein may be formed of materials including, but not limited to, thermoplastic, carbon composite, plastic, nylon, polyethylene, polyetherimide, polypropylene, polyvinyl chloride, steel, aluminum, stainless steel, titanium, high strength aluminum alloy, other plastic or polymer materials, other metallic materials, other composite materials, or other similar materials. Moreover, the components of the devices described herein may be attached to one another via suitable fasteners, which include, but are not limited to, screws, bolts, rivets, welds, over-molding, co-molding, injection molding, or other mechanical or chemical fasteners.

Different arrangements of the components depicted in the drawings or described above, as well as components and steps not shown or described, are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A firearm receiver assembly comprising:
a receiver body comprising a plurality of cavities; and
a plurality of rails, wherein:
each of the plurality of rails is disposed in one of the plurality of cavities;
each of the plurality of rails comprises at least one retaining feature; and
the at least one retaining feature comprises a protrusion that penetrates an interior portion of the corresponding cavity.

2. The firearm receiver assembly of claim 1, wherein at least a portion of each of the plurality of rails is metallic.

3. The firearm receiver assembly of claim 1, wherein at least a portion of the receiver body comprises a polymer material.

4. The firearm receiver assembly of claim 1, wherein engagement of the at least one retaining feature with the receiver body permanently attaches the corresponding rail relative to the receiver body.

5. The firearm receiver assembly of claim 1, wherein at least one of the plurality of rails includes multiple parts.

6. The firearm receiver assembly of claim 1, wherein at least one of the plurality of cavities includes an upper opening and a lower opening.

7. The firearm receiver assembly of claim 1, wherein:
the plurality of rails comprises two front rails and at least one rear rail;
each front rail comprises a first member and a second member;
the first member comprises a slide interface portion designed to interface with a slide assembly of a handgun; and
the second member comprises at least one retaining feature.

8. The firearm receiver assembly of claim 7, wherein the at least one retaining feature comprises a protrusion that penetrates the interior of the corresponding cavity.

9. The firearm receiver assembly of claim 1, wherein:
the plurality of rails comprises at least one rear rail;
the at least one rear rail comprises a stabilizing feature comprising at least one selected from the group of a notch or a protrusion; and
the stabilizing feature engages a corresponding feature of the receiver body to reduce movement of the rear rail relative to the receiver body.

10. A handgun receiver assembly comprising:
a receiver body comprising a plurality of cavities;
at least one front rail at least partially disposed in one of the plurality of cavities; and
at least one rear rail at least partially disposed in one of the plurality of cavities, wherein:
the at least one front rail comprises at least one retaining feature that is integral to the at least one front rail; and
engagement of the at least one retaining feature with the receiver body permanently attaches the corresponding rail relative to the receiver body.

11. The handgun receiver assembly of claim 10, wherein the at least one front rail comprises a front left rail inserted into a first cavity of the receiver body and a front right rail inserted into a second cavity of the receiver body.

12. The handgun receiver assembly of claim 10, wherein:
each at least one front rail comprises a first member and a second member;
the first member comprises a slide interface portion that protrudes out of the top of the appropriate cavity; and
the second member comprises a "L" shape.

13. The handgun receiver assembly of claim 12, wherein the second member comprises a protrusion that penetrates the interior of the corresponding cavity.

14. The handgun receiver assembly of claim 12, wherein the first member comprises a lower protrusion configured to engage a corresponding shelf in the cavity.

15. The handgun receiver assembly of claim 10, wherein at least a portion of the receiver body comprises a polymer material.

16. The handgun receiver assembly of claim 10, wherein at least one of the plurality of cavities includes an upper opening and a lower opening.

17. The handgun receiver assembly of claim 10, wherein the at least one rear rail comprises a single component with an overall U shape with two slide interface portions.

18. The handgun receiver assembly of claim 10, wherein the at least one rear rail comprises:

a hole designed to interface with a pin to locate the at least one rear rail relative to the receiver body; and a stabilizing feature comprising at least one selected from the group of a notch or a protrusion, wherein the stabilizing feature is configured to engage a corresponding feature of the receiver body to reduce movement of the at least one rear rail relative to the receiver body.

19. The handgun receiver assembly of claim 10, wherein the at least one rear rail comprises two internal interface portions that each bend inboard toward a center of the rear rail, wherein the internal interface portions are designed to interface with a trigger housing.

20. A firearm receiver assembly comprising:

a receiver body comprising a plurality of cavities; and a plurality of rails, comprising two front rails and at least one rear rail, wherein:

each of the plurality of rails is disposed in one of the plurality of cavities;

each of the plurality of rails comprises at least one retaining feature;

each front rail comprises a first member and a second member;

the first member comprises a slide interface portion designed to interface with a slide assembly of a handgun;

the second member comprises at least one retaining feature; and the at least one retaining feature comprises a protrusion that penetrates the interior of the corresponding cavity.

* * * * *